United States Patent [19]

Bjorgum

[11] 4,230,353

[45] Oct. 28, 1980

[54] CARPET DOOR STOP

[76] Inventor: Keith D. Bjorgum, 2341 Estrellita Way, Sacramento, Calif. 95825

[21] Appl. No.: 902,432

[22] Filed: May 3, 1978

[51] Int. Cl.[3] ..... E05C 17/54

[52] U.S. Cl. ..... 292/343

[58] Field of Search ..... 16/82, 85, 86 R, 86 C; 292/342, 343, DIG. 15

[56] References Cited

U.S. PATENT DOCUMENTS

| | | | |
|---|---|---|---|
| 61,874 | 2/1867 | Rosenblatt | 292/343 |
| 372,655 | 11/1887 | Cashin | 292/343 |
| 435,226 | 8/1890 | Imler | 292/343 |
| 929,287 | 7/1909 | Collins | 292/343 |
| 932,694 | 8/1909 | Fulton et al. | 292/343 |
| 1,006,788 | 10/1911 | Price | 292/343 |
| 1,154,148 | 9/1915 | West | 292/343 |
| 1,338,205 | 4/1920 | Albright | 292/343 |
| 1,354,046 | 9/1920 | Lanning | 292/343 |
| 3,328,065 | 6/1967 | Arenson | 292/343 |

*Primary Examiner*—George H. Krizmanich
*Attorney, Agent, or Firm*—Blair, Brown & Kreten

[57] ABSTRACT

Disclosed herein is a stop for doors which open into rooms having a solid carpet (such as wall-to-wall carpet that is fastened down) and comprises a handle, a base member and downwardly extending projections angulated so that they slant away from the door. When placed in proximate relation to the door, the unauthorized opening of the door is prevented to the extent that entry into that room is impossible without damaging the door.

2 Claims, 4 Drawing Figures

FIG.1
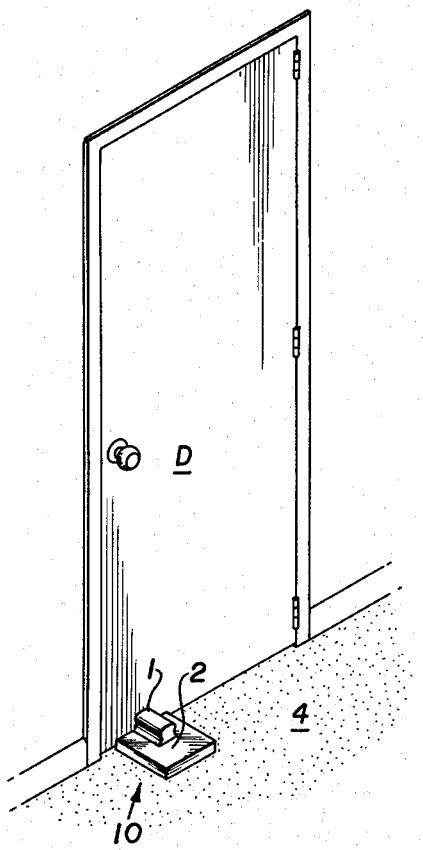
FIG.4
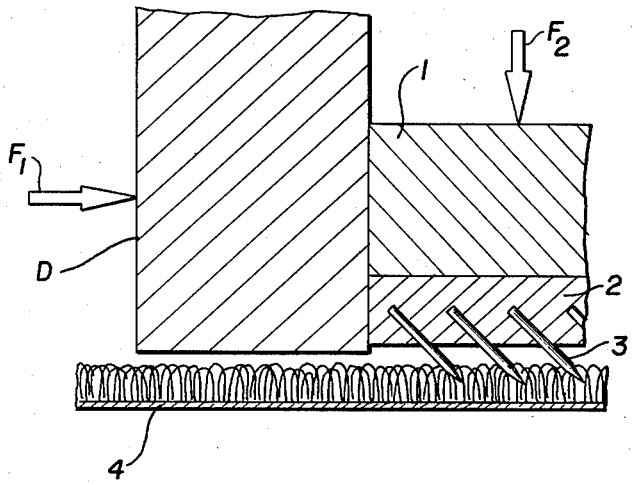
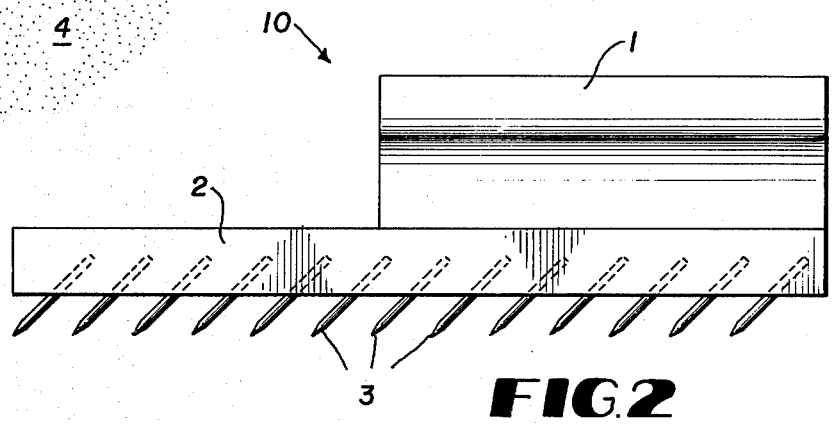
FIG.2
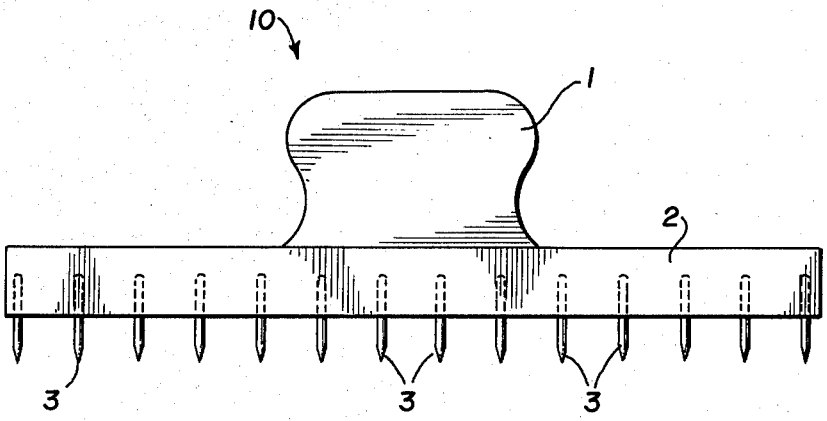
FIG.3

CARPET DOOR STOP

BACKGROUND OF THE INVENTION

The stopping of doors is known in the prior art to prevent unauthorized entry into a room or area, and the stops normally associated with same comprise structure similar to the following patents, of which applicant is aware:

U.S. Pat. No. 778,823, Fay
U.S. Pat. No. 1,064,320, Glindkamp
U.S. Pat. No. 1,392,467, Topp
U.S. Pat. No. 1,442,991, Auclair
U.S. Pat. No. 1,943,826, Holtzman
U.S. Pat. No. 3,583,743, Newell None of these references teach either the concept or the structure of the present invention and accordingly, do not provide the safety, tamper-proof ability, easy removal in case of emergency, portability, or use in any room with a solid carpet.

SUMMARY OF THE INVENTION

Accordingly, the ensuing description contemplates providing a carpet stop for doors which is easily engageable.

Another objects contemplates providing a door stop for use in a room having solid carpet which is portable, tamper-proof, and easily removed in case of emergencies.

These and other objects will be manifest when considering the following detailed drawings and specifications.

BRIEF DESCRIPTION OF THE DRAWINGS

FIG. 1 depicts an isometric view of the stop according to the present invention installed next to a door.

FIG. 2 is a side view of the door stop.

FIG. 3 is an end view thereof, and

FIG. 4 shows the reactive forces applied on a door and the functioning of the stop in cross section.

BRIEF DESCRIPTION OF THE PREFERRED EMBODIMENT

Referring to the drawings now wherein like reference numerals refer to like parts throughout the various drawings, reference numeral 10 is generally directed to the carpet door stop according to the present invention.

The carpet door stop comprises a handle member 1 supported upon a base member 2 and extending downwardly from the base member 2 are angulated spikes 3 in which the angle of orientation is such that the spikes extend outwardly and downwardly from the door, as best shown in FIGS. 2 or 4. The base member has a planar side wall which abuts the door face.

It is apparent, therefore, that the spikes 3 engaging in the threads and base of carpet 4 provide not only a frictional type of resistance to unauthorized opening of the door, but the spikes can project into the carpet making unauthorized opening of the door extremely difficult without damaging either the door D or the carpet 4.

FIG. 4 demonstrates how the force $F_1$ applied on the door is translated to a downward force $F_2$ onto the carpet stop. It is apparent, therefore, that an upward force opposite in sense from $F_2$ would result in removing the door stop thereby making it easily engageable.

Having thus described the invention, it will be apparent that numerous structural modifications are contemplated as being a part of this invention as specified hereinabove and as defined hereinbelow by the claims.

I claim:

1. A door stop for use in carpeted rooms comprising a handle member, a base member disposed on and below said handle member, said base member having substantially planar and parallel top and bottom portions and perpendicular planar side walls therebetween and means to engage a carpet in the room to provide resistance to a door being opened when one of the said side walls is placed in proximate position to a vertical face of the door.

2. The device of claim 1 wherein said means comprises a plurality of spikes extending downwardly from said base member and outwardly angulated relative to said door.

* * * * *